US012410784B2

(12) United States Patent
Jiang

(10) Patent No.: US 12,410,784 B2
(45) Date of Patent: Sep. 9, 2025

(54) DUAL-PURPOSE AIR PUMP

(71) Applicant: ZHONG SHAN SMART PLASTIC MANUFACTURING LTD., Guangdong (CN)

(72) Inventor: Zelong Jiang, Guangdong (CN)

(73) Assignee: ZHONG SHAN SMART PLASTIC MANUFACTURING LTD., Zhongshan (CN)

( * ) Notice: Subject to any disclaimer, the term of this patent is extended or adjusted under 35 U.S.C. 154(b) by 7 days.

(21) Appl. No.: 18/437,265

(22) Filed: Feb. 9, 2024

(65) Prior Publication Data

US 2024/0376876 A1 Nov. 14, 2024

(30) Foreign Application Priority Data

May 10, 2023 (CN) ..... 202310528020.5
May 10, 2023 (CN) ..... 202321125420.3

(51) Int. Cl.
*F04B 35/04* (2006.01)
*F04B 35/06* (2006.01)
*F04B 39/12* (2006.01)

(52) U.S. Cl.
CPC ..... *F04B 35/04* (2013.01); *F04B 35/06* (2013.01); *F04B 39/121* (2013.01)

(58) Field of Classification Search
CPC ..... F04B 35/04; F04B 35/06; F04B 39/121; F04D 17/10; F04D 17/16; F04D 17/165; F04D 25/06; F04D 25/084; F04D 27/008; F04D 29/40; F04D 29/403; F04D 29/42; F04D 29/4206; F04D 29/4226; F04D 29/60; F04D 29/601; F04D 29/602; F04D 29/603; F04D 29/62; F04D 29/624; A47C 27/082
See application file for complete search history.

(56) References Cited

U.S. PATENT DOCUMENTS

2003/0215340 A1* 11/2003 Chung ..... F04D 29/503 5/706
2006/0275152 A1* 12/2006 Borowski ..... F04D 29/582 417/423.15
2022/0136524 A1 5/2022 Qin et al.

FOREIGN PATENT DOCUMENTS

CN 103511302 A 1/2014
CN 212155088 U 12/2020
CN 216589009 U 5/2022

* cited by examiner

*Primary Examiner* — Loren C Edwards

(57) ABSTRACT

A dual-purpose air pump comprised a pump body, a housing which is provided with an accommodating cavity receiving the pump body, a bottom of the housing has an air inlet and outlet, the pump body is rotationally mated with the housing, the pump body has a twirling part protruding from the housing; an outer side wall of the pump housing is provided with a limiting table, the housing is provided with a locking device which can move to and from an upper part of the limit table, the pump body has a power switch, and the housing has a switch trigger capable of turning off the power switch when the pump body is rotated. The pump body is built into the housing for use or removed from it for separate use, and a mechanical switch can still work when the pump body is built into the housing.

11 Claims, 8 Drawing Sheets

DUAL-PURPOSE AIR PUMP

CROSS REFERENCE TO RELATED APPLICATIONS

The present application claims the benefit of Chinese Patent Applications Nos. 202310528020.5 and 202321125420.3 and filed on May 10, 2023. All the above are hereby incorporated by reference in their entirety.

TECHNICAL FIELD

The invention relates to the technical field of electric air pumps, in particular to a dual-purpose air pump.

BACKGROUND ART

Inflatable products (including inflatable beds, inflatable swimming pools, inflatable boats, inflatable toys, etc.) are becoming increasingly popular due to their advantages of light weight, small size, and convenient portability, and their application scenarios are becoming more and more extensive.

In order to achieve rapid inflation of inflatable products, air pumps are inevitably used for inflation. There are two types of existing air pump structures, one is the built-in structure, the pump body is directly integrated with the inflatable product and can only inflate the inflatable product, resulting in a relatively single usage function. The other is the external structure, the pump body is completely independent of the inflatable product, the advantage is that it can inflate a variety of inflatable products, but the disadvantage is that it needs to be stored and carried separately.

In order to solve the above problem, the patent with publication number CN 216589009 U discloses a separable dual-purpose air pump, the air pump comprises an outer housing and an inflating device, the inflating device can be used inside the outer housing or taken out of the outer housing for separate use, however, this air pump also has the following problems, since the entire inflating device is enclosed inside the outer housing after the inflating device is incorporated into the outer housing, it cannot be mechanically switched on or off, nor can the speed of inflation and deflation be adjusted by means of mechanical switches.

SUMMARY

In view of this, the object of the invention is to provide a dual-purpose air pump, the pump body of the air pump can be built into the housing for use, or can be removed from the housing for separate use, and a mechanical switch can still work when the pump body is built into the housing.

The technical solution adopted by the invention to solve its technical problems is:

A dual-purpose air pump, comprising a pump body and a housing which can be fixed to an inflatable product, wherein the housing is provided with an accommodating cavity with a top opening, and a bottom of the housing is provided with an air inlet and outlet, the pump body can be inserted into the accommodating cavity and rotationally mated with the housing, an upper end of the pump body is provided with a twirling part that can rotate relative to the housing together with the pump body, and the twirling part protrudes from an upper end face of the housing; the pump body comprises a pump housing, and an outer side wall of the pump housing is provided with a limiting table, the housing is provided with a locking device which can move to an upper part of the limiting table to limit an upward movement of the pump body, when the locking device is moved away from the upper part of the limiting table, it allows the pump body to move upwards and detach from the accommodating cavity; the pump body is provided with a power switch, and the housing is internally provided with a switch trigger which can close the power switch, when the pump body rotates, the power switch can be rotated to a position triggered by the switch trigger.

In a preferred embodiment of the invention, the power switch comprises an elastic button, the switch trigger comprises a ramp provided along an inner side wall of the housing in a circumferential direction, the elastic button is squeezed by the ramp to close the power switch when the elastic button is rotated to a position where the ramp is located.

In a preferred embodiment of the invention, the pump housing is provided with a fixing base, the power switch further comprises a normally-open switch mounted on the fixing base, the normally-open switch is provided with a trigger clastic piece, and the pump housing is provided with a button hole, the elastic button comprises a pressing member movably installed at the button hole and a return spring which can drive the pressing member to move outwards to reset, one end of the pressing member extends out of the pump housing, the pressing member is capable of pressing against the trigger clastic piece to close the normally-open switch when the pressing member moves towards inside the pump housing.

In a preferred embodiment of the invention, the pump housing is further provided with a mounting groove, and the mounting groove is provided with a manual switch member which can be moved up and down along the mounting groove, a part of the manual switch member is exposed outside the pump housing, and a part of the manual switch member extends into the interior of the pump housing, the trigger elastic piece is provided with a switch ramp inclined relative to the mounting groove, the manual switch member presses against the switch ramp to close the normally-open switch when moving up or down.

In a preferred embodiment of the invention, an upper or a lower end of the manual switch member is provided with a bolt rod, and the pressing member is provided with a vertical bolt hole corresponding to the bolt rod, when the manual switch member is moved to a position where the switch ramp is pressed, the bolt rod is inserted into the vertical bolt hole to limit the movement of the manual switch member relative to the pump housing.

In a preferred embodiment of the invention, the bottom of the housing is provided with a valve core for sealing the air inlet and outlet, and a bottom of the pump housing is provided with a pushing bevel which can push the valve core open when the power switch is rotated towards the switch trigger, the valve core is connected with an elastic resetting member which can drive it to reset thereof to seal the air inlet and outlet.

In a preferred embodiment of the invention, the valve core comprises a cover plate which covers a lower end face of the air inlet and outlet, a sealing ring disposed on an upper surface of the cover plate, and a bearing member fixed on the upper surface of the cover plate, the bearing member, its upper end extends into the interior of the housing, and the upper end of the bearing member is provide with a bearing bevel which cooperates with the pushing bevel.

In a preferred embodiment of the invention, a lower surface of the housing is provided with a support frame, the cover plate is located between the housing and the support frame, an inner side of the support frame is provided with a vertical guide post, and the cover plate is provided with a guide hole matching the guide post.

In a preferred embodiment of the invention, the locking device comprises a plurality of elastic fasteners disposed on an upper part of the housing, each of the elastic fasteners is provided with a fastening part which can move to a top of the limiting table under its own elastic force, when the fastening parts are removed from the top of the limiting table under an action of external force, the elastic fasteners undergo elastic deformation.

In a preferred embodiment of the invention, the bottom of the housing is provided with a pressing spring which can press the pump body upward so that the limiting table abuts against the locking device.

In a preferred embodiment of the invention, an inner bottom of the housing is provided with an elastic positioning pin, and a bottom of the pump body is provided with a plurality of recesses which cooperate with the elastic positioning pin, when the pump body is twirled, the elastic positioning pin disengages from one recess and switches into another recess.

In a preferred embodiment of the invention, an outer side wall of the twirling part is provided with at least an anti-slip pattern.

The beneficial effects of the invention are:

First, the air pump of the invention, the pump body can be built in the housing for use or can be removed from the housing for separate use.

Second, when the pump body is built in the housing for use, the pump body is also can be controlled to start and stop by means of mechanical switch. The twirling part of the pump body is exposed, and by rotating the twirling part, the whole pump body can be driven to rotate relative to the housing, so that the power switch is moved to the position triggered by the switch trigger, and at this time the motor inside the pump body is energized, so that the inflatable product can be inflated or deflated. Reverse rotation of the pump body can move the power switch to the position that is staggered from the switch trigger. At this time, the power switch is turned off and the pump body stops working.

DETAILED DESCRIPTION OF THE INVENTION

Figure 1:
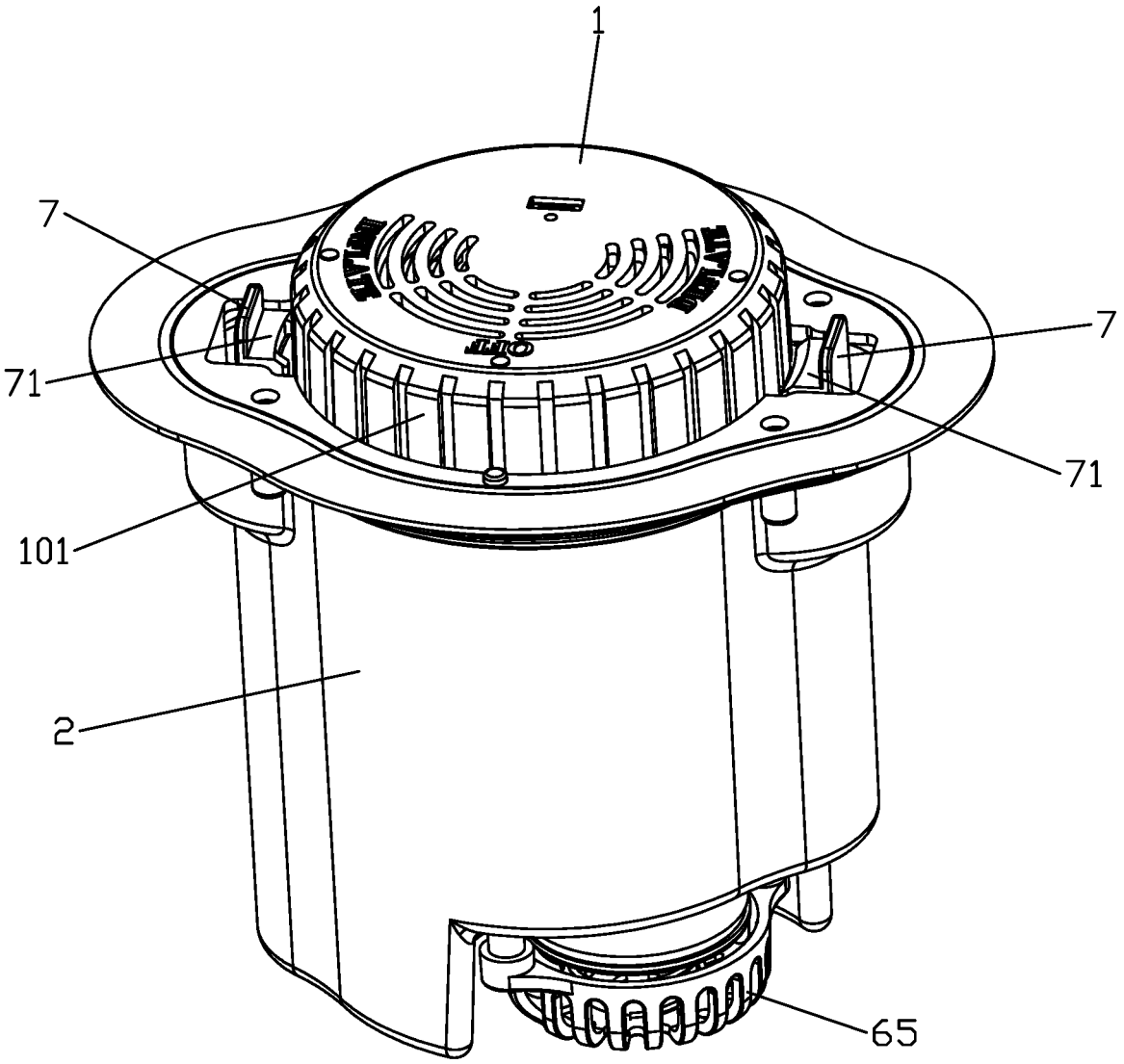
FIG. 1 is a perspective view of the air pump.

The technical solution of the invention will be clearly and completely described below in conjunction with the accompanying drawings.

It should be noted that all directional indications in the invention, such as up, down, left, right, front, back. It is only used to explain a relative positional relationship, movement, etc., between the various components in a particular posture (as shown in the accompanying drawings), and that the directional indications change accordingly if the particular posture is changed. Further, the descriptions involving "preferred", "sub-preferred", and the like in the invention are used for descriptive purposes only, and cannot be construed as indicating or implying their relative importance, or as implicitly specifying the number of the indicated technical features. Accordingly, a feature defined as "preferred" or "sub-preferred" may explicitly or implicitly include at least one of these features.

Referring to FIGS. 1 to 8, the invention proposes a dual-purpose air pump, comprising a pump body 1 and a housing 2 which can be fixed to an inflatable product, wherein the housing 2 is provided with an accommodating cavity 20 with a top opening, a bottom of the housing 2 is provided with an air inlet and outlet 21, the pump body 1 can be inserted into the accommodating cavity 20 and rotationally mated with the housing 2, an upper end of the pump body 1 is provided with a twirling part 101 that can rotate relative to the housing 2 together with the pump body 1, and the twirling part 101 protrudes from an upper end face of the housing 2. An upper end of the housing 2 is provided with an extended edge which can be welded to the inflatable product.

In order to increase friction, the outer side wall of the twirling part 101 is provided with at least an anti-slip pattern.

The pump body 1 is cylindrical in shape, the pump body 1 comprises a pump housing 11, an impeller 12 disposed inside the pump housing 11 and a motor 13 which can drive the impeller 12 to rotate, a bottom of the pump housing 11 is provided with a deflation port 111 and an inflation port 112, an outer side wall of the pump housing 11 is provided with a limiting table 102, the housing 2 is provided with a locking device which can move to an upper part of the limiting table 102 to limit an upward movement of the pump body 1, when the locking device is moved away from the upper part of the limiting table 102, it allows the pump body 1 to move upwards and detach from the accommodating cavity 20.

The pump body 1 is provided with a power switch, and the housing 2 is internally provided with a switch trigger which can close the power switch, the pump body 1 is capable of rotating the power switch to a position triggered by the switch trigger during rotation.

When the air pump of the invention is built-in an inflatable product for use, the extended edge of the upper end of the housing 2 is welded to the inflatable product, the twirling part 101 of the pump body 1 is exposed out of the inflatable product, and by rotating the twirling part 101, the whole pump body 1 can be driven to rotate relative to the housing 2, so that the power switch is moved to a position triggered by the switch trigger, at this time the motor 13 inside the pump body 1 is energized, the inflatable product can be inflated or deflated. Reverse rotation of the pump body 1 can move the power switch to a position that is staggered from the switch trigger, at this time, the power switch is turned off and the pump body 1 stops working. After removing the locking device from the top of the limiting table 102, the pump body 1 can be taken out from the housing 2 for separate use.

Figure 2:
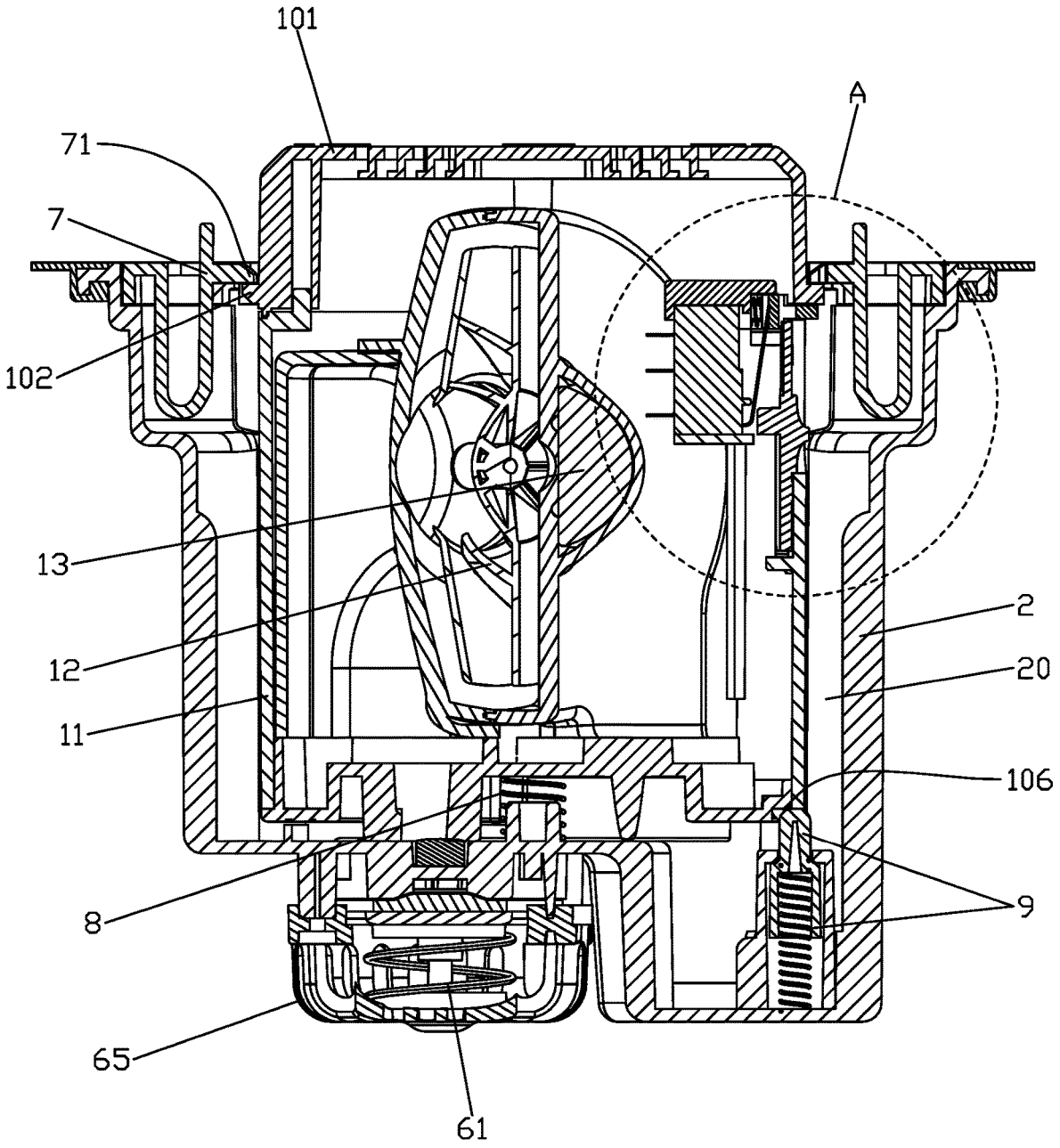
FIG. 2 is a sectional view of the air pump.
Figure 3:
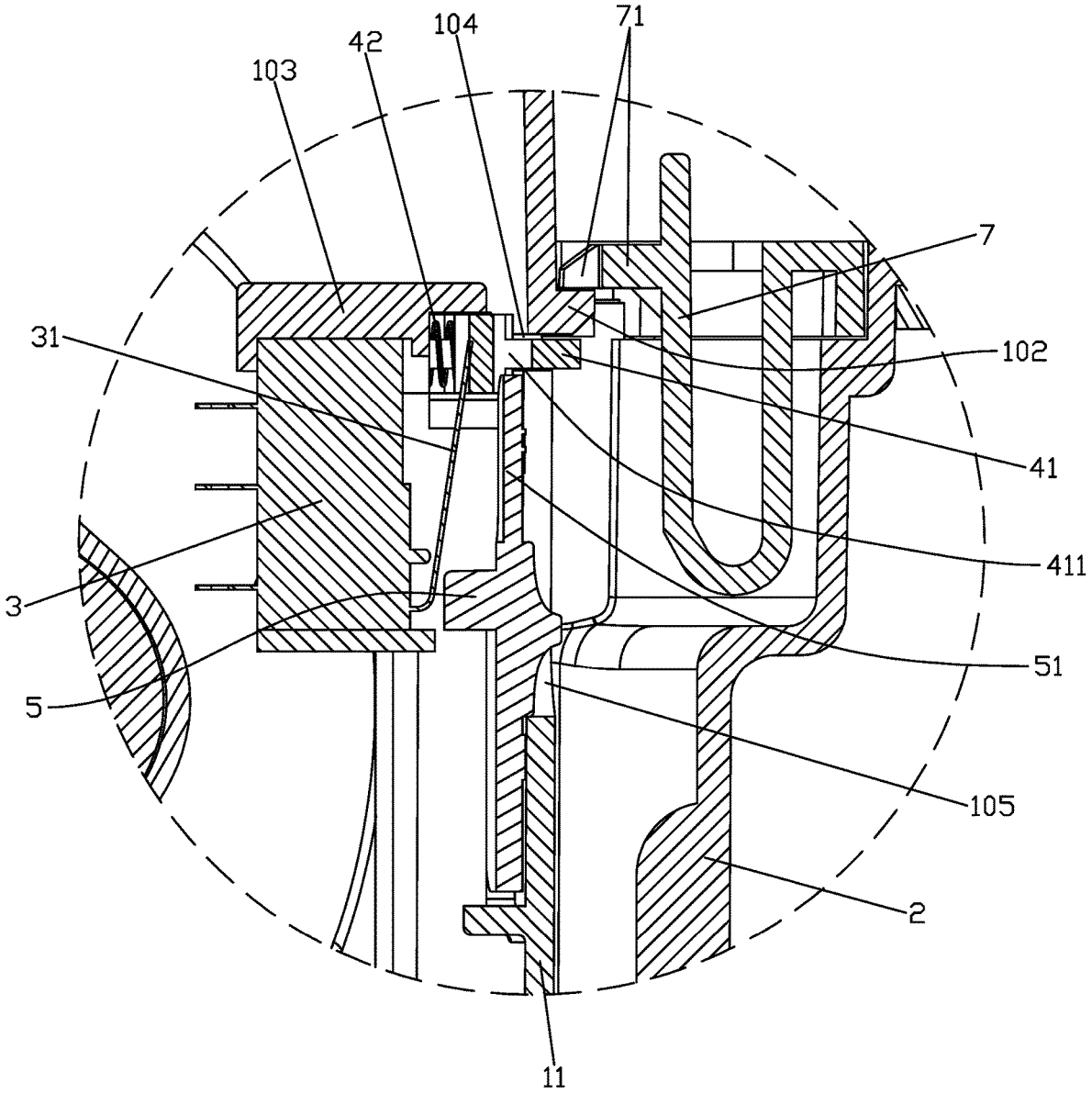
FIG. 3 is an enlarged view of part A of FIG. 2.
Figure 4:
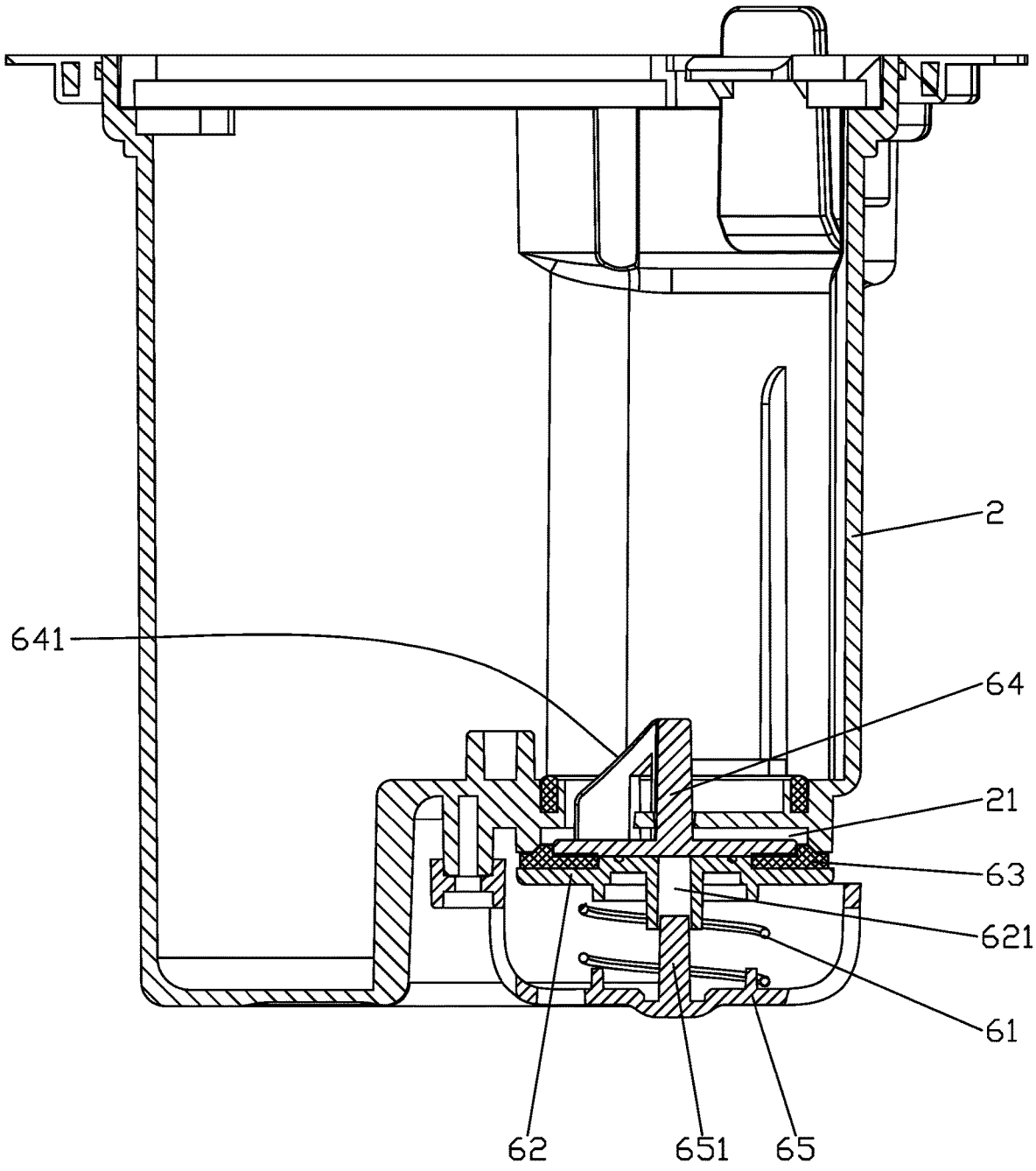
FIG. 4 is a schematic diagram of a connecting structure between the valve core and the housing.
Figure 5:
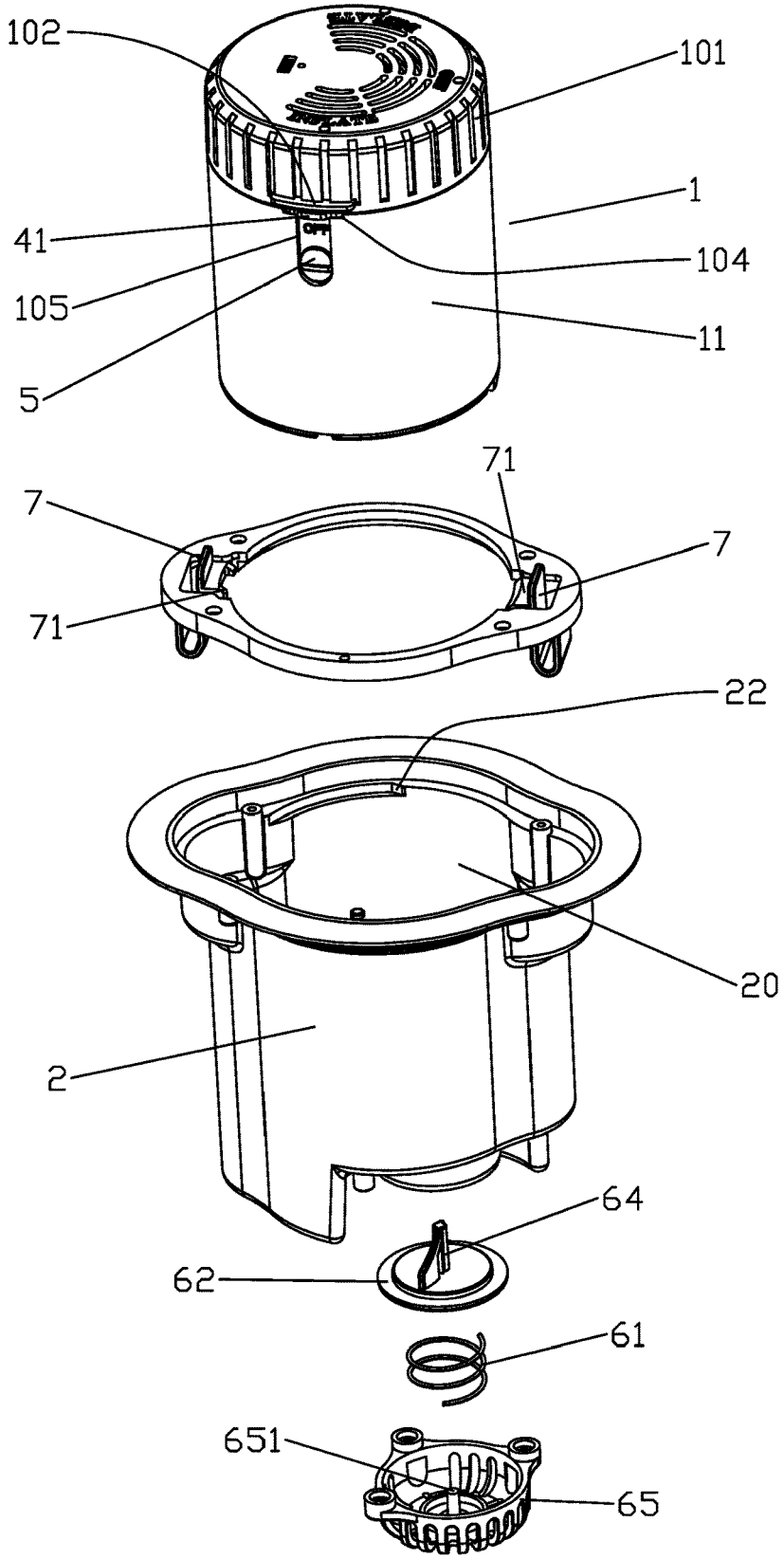
FIG. 5 is an exploded view of the air pump.
Figure 6:
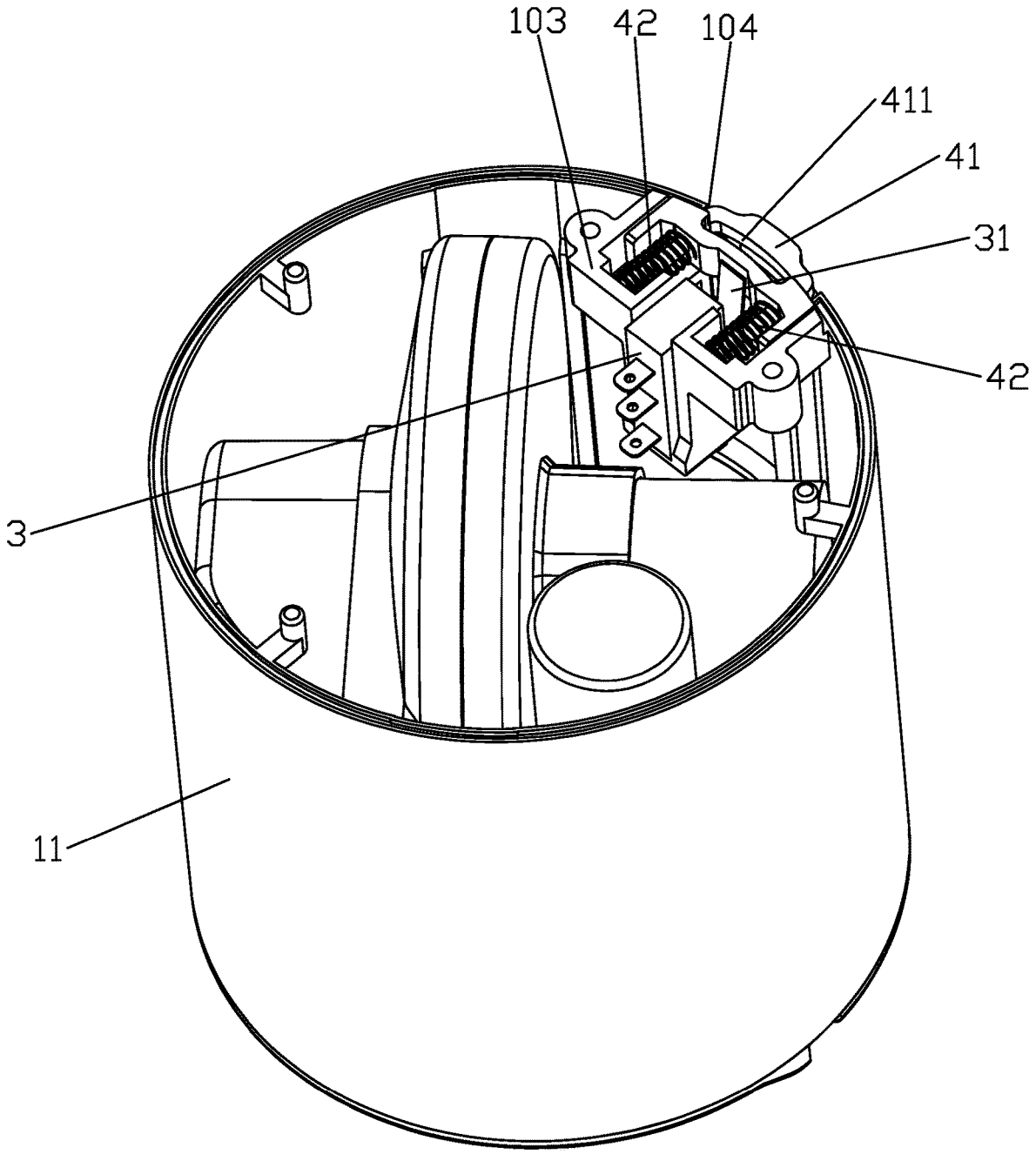
FIG. 6 is an internal structural view of the pump body.
Figure 7:
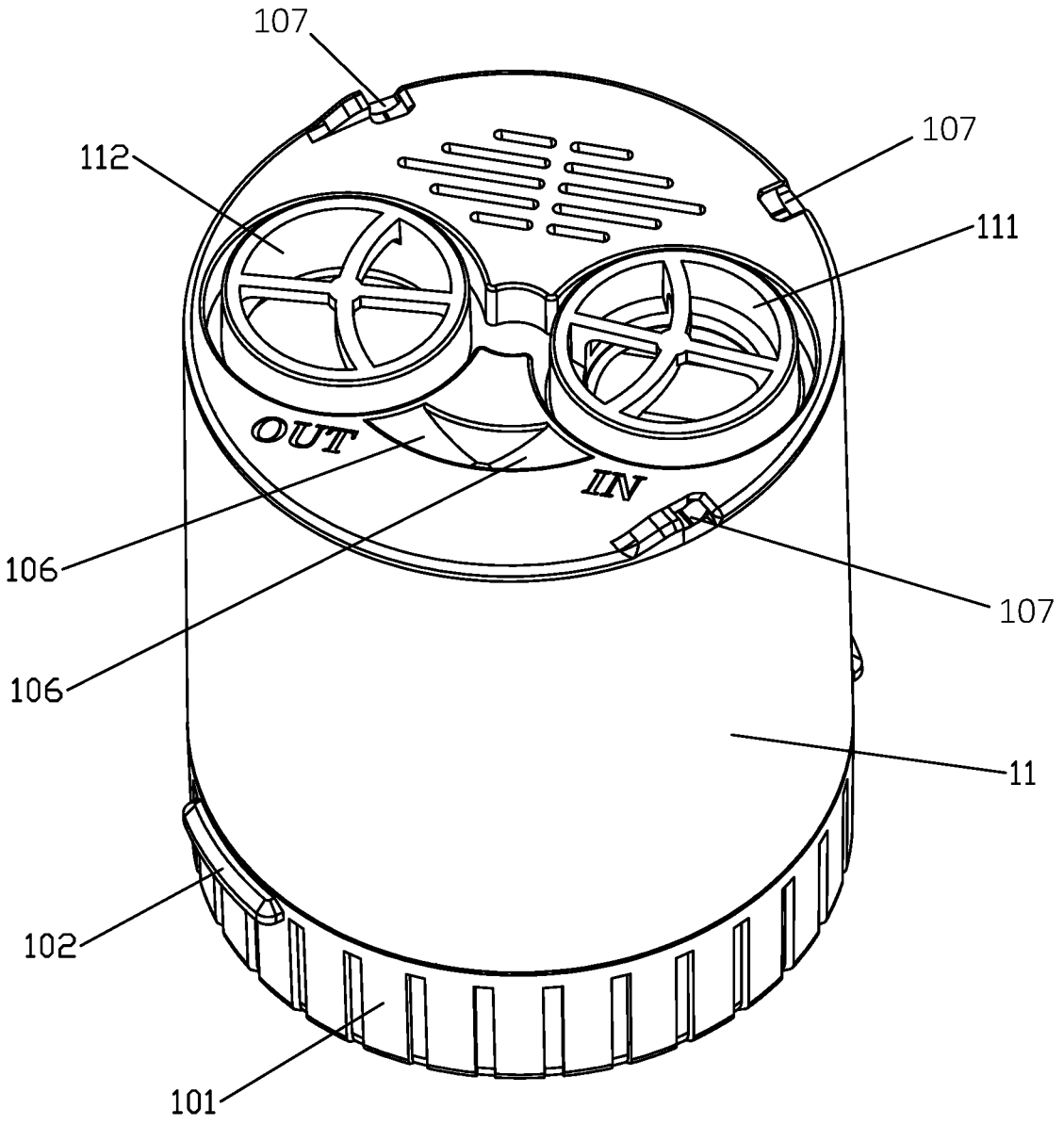
FIG. 7 is a perspective view of the pump body.
Figure 8:
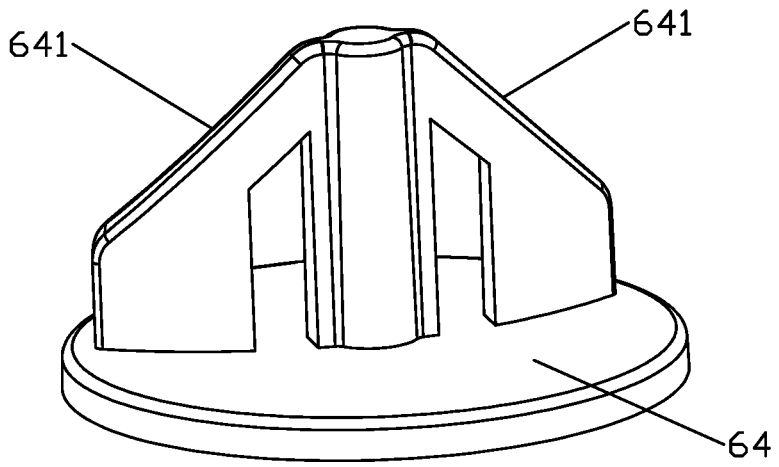
FIG. 8 is a perspective view of the bearing member.

Referring to FIGS. 2 and 3, in a preferred embodiment of the invention, the pump housing 11 is internally provided with a fixing base 103, the power switch comprises an elastic button, and a normally-open switch 3 mounted on the fixing base 103, the normally-open switch 3 is provided with a trigger elastic sheet 31, and the pump housing 11 is provided with a button hole 104, the elastic button comprises a pressing member 41 movably installed at the button hole 104 and a return spring 42 which can drive the pressing member 41 to move outwards to reset, one end of the pressing member 41 extends out of the pump housing 11. The switch trigger comprises a ramp 22 provided along an inner side wall of the housing 2 in a circumferential direction, the pressing member 41 is squeezed by the ramp 22 when rotating to the position where the ramp 22 is located, causing the pressing member 41 to move towards the interior of the pump housing 11, which in turn presses against the trigger clastic piece 31 to close the normally-open switch 3. When the pressing member 41 is rotated away from the ramp 22, the pressing member 41 is reset outwardly under the clastic force of the return spring 42, and when the pressing member 41 is disengaged from the trigger clastic piece 31, the normally-open switch 3 is turned off.

Further, the pump housing 11 is further provided with a mounting groove 105, and the mounting groove 105 is provided with a manual switch member 5 which can be moved up and down along the mounting groove 105, a part of the manual switch member 5 is exposed outside the pump housing 11, and a part of the manual switch member 5 extends into the interior of the pump housing 11, the trigger clastic piece 31 is provided with a switch ramp inclined relative to the mounting groove 105, the manual switch member 5 presses against the switch ramp to close the normally-open switch 3 when moving up or down, and when the manual switch member 5 is disengaged from the trigger elastic piece 31, the normally-open switch 3 is turned off. Adopting such a design has the following advantages, when the pump body 1 is taken out of the housing 2 and used alone, the pump body 1 can be turned on by moving the manual switch member 5 up and down, and the pump body 1 can be kept working for a long period of time without any other external force, which is very convenient, and if the pump body 1 is turned on by the pressing member 41, it is necessary to continuously press the pressing member 41 to keep the pump body 1 working for a long period of time.

Further, an upper end or a lower end of the manual switch member 5 is provided with a bolt rod 51, and the pressing member 41 is provided with a vertical bolt hole 411 corresponding to the bolt rod 51, when the manual switch member 5 is moved to a position where the switch ramp is pressed, the bolt rod 51 is inserted into the vertical bolt hole 411 to limit the movement of the manual switch member 5 relative to the pump housing 11. Adopting such a design has the following advantages, after adopting the manual switch member 5 to turn on the pump body 1, it can avoid the user from mistakenly touching the pressing member 41, and avoid the trigger elastic piece 31 of the normally-open switch 3 from being subjected to metal fatigue due to the double extrusion of the manual switch member 5 and the pressing member 41, which is conducive to enhancing the service life of the normally-open switch 3.

Further, the bottom of the housing 2 is provided with a valve core which seals the air inlet and outlet 21, and the bottom of the pump housing 11 is provided with a pushing bevel 106 which can push the valve core when the power switch is rotated towards the switch trigger, the valve core is connected with an elastic resetting member 61 which can drive it to reset thereof to seal the air inlet and outlet 21. Specifically, the valve core comprises a cover plate 62 which covers a lower end face of the air inlet and outlet 21, a sealing ring 63 disposed on an upper surface of the cover plate 62, and a bearing member 64 fixed on the upper surface of the cover plate 62, the bearing member 64, its upper end extends into the interior of the housing 2, and the upper end of the bearing member 64 is provide with a bearing bevel 641 which cooperates with the pushing bevel. A lower surface of the housing 2 is provided with a support frame 65, the cover plate 62 is located between the housing 2 and the support frame 65, the elastic resetting member 61 is a spring disposed between the support frame 65 and the cover plate 62, an inner side of the support frame 65 is provided with a vertical guide post 651, and the cover plate 62 is provided with a guide hole 621 matching the guide post 651. When the invention is built-in an inflatable product for use, while screwing the pump body 1, it can not only automatically turn off the power switch, but also automatically open the valve core to open the air inlet and outlet 21, and then the inflatable product can be inflated by the pump body 1. At the same time as the pump body 1 is twirled to turn off the power switch, the valve core is automatically reset under an elastic force of the elastic resetting member 61 to close the air inlet and outlet 21.

In a preferred embodiment of the invention, the locking device comprises a plurality of elastic fasteners 7 disposed on an upper part of the housing 2, each of the elastic fasteners 7 is provided with a fastening part 71 which can move to a top of the limiting table 102 under its own elastic force, when the fastening parts 71 are moved away from the top of the limiting table 102 under an action of external force, the elastic fasteners 7 undergo clastic deformation.

Further, the bottom of the housing 2 is provided with a pressing spring 8 which can press the pump body 1 upward to bring the limiting table 102 into contact with the locking device. With such a design, when the invention is built-in an inflatable product for use, the pump body 1 can be effectively prevented from swaying inside the housing due to the existence of a gap between the pump body 1 and the housing.

Further, the housing 2, its inner bottom, is provided with at least an elastic positioning pin 9, and the bottom of the pump body 1 is provided with a plurality of recesses 107 which cooperate with the elastic positioning pin 9, an upper end of the elastic positioning pin 9 is an arc surface, when the pump body 1 rotates, the elastic positioning pin 9 disengages from one recess 107 and switches into another recess 107. The number of recesses 107 is generally three, corresponding to the three states of deflation, inflation and shutdown of the pump body 1.

In some embodiments of the invention, the power switch described above may also adopt other structural forms, such as using a Hall switch, whereby the switch trigger accordingly employs a magnet capable of triggering the Hall switch, or using a travel switch, whereby the switch trigger is mounted on the rotation path of the travel switch.

In some embodiments of the invention, the locking device may also adopt other structural forms, such as using a pressure block and a spring that are radially movable relative to the pump body 1, and the pressure block is able to move to the top of the limiting table 102 under an elastic force of the spring; when the pump body 1 needs to be taken out of the housing 2, the elasticity of the spring is overcome, the pressure block is removed, and the pump body 1 can then be taken out.

The above are only preferred embodiments of the invention and are not intended to limit the patent scope of the invention, any equivalent structural transformation made by using the description and drawings of the invention in the concept of the invention, or directly or indirectly applied in other related technical fields, are included in the scope of patent protection of the invention.

What is claimed is:

1. A dual-purpose air pump, comprising a pump body (1) and a housing (2) configured to be fixed to an inflatable product, wherein the housing (2) is provided with an accommodating cavity (20) with a top opening, and a bottom of the housing (2) is provided with an air inlet and outlet (21), the pump body (1) configured to be inserted into the accommodating cavity (20) and rotationally mated with the housing (2), an upper end of the pump body (1) is provided with a twirling part (101) configured to rotate relative to the housing (2) together with the pump body (1), and the twirling part (101) protrudes from an upper end face of the housing (2);

the pump body (1) comprises a pump housing (11), an outer side wall of the pump housing (11) is provided with a limiting table (102), the housing (2) is provided with a locking device configured to move to an upper part of the limiting table (102) to limit upward movements of the pump body (1), when the locking device is moved away from the upper part of the limiting table (102), the locking device allows the pump body (1) to move upwards and detach from the accommodating cavity (20);

the pump body (1) is provided with a power switch, and the housing (2) is internally provided with a switch trigger configured to close the power switch, when the pump body (1) rotates, the power switch is configured to be rotated to a position triggered by the switch trigger;

wherein the locking device comprises a plurality of elastic fasteners (7) disposed on an upper part of the housing (2), each of the elastic fasteners (7) is provided with a fastening part (71) configured to move to a top of the limiting table (102) under elastic force of the fastening part (71), when the fastening parts (71) are removed from the top of the limiting table (102) under an action of external force, the elastic fasteners (7) undergo elastic deformation.

2. The dual-purpose air pump according to claim 1, wherein the power switch comprises an elastic button, the switch trigger comprises a ramp (22) provided along an inner side wall of the housing (2) in a circumferential direction, the elastic button is squeezed by the ramp (22) to close the power switch when the elastic button is rotated to a position where the ramp (22) is located.

3. The dual-purpose air pump according to claim 2, wherein the pump housing (11) is provided with a fixing base (103), the power switch further comprises a normally-open switch (3) mounted on the fixing base (103), the normally-open switch (3) is provided with a trigger elastic piece (31), the pump housing (11) is provided with a button hole (104), the elastic button comprises a pressing member (41) movably installed at the button hole (104) and a return spring (42) configured to drive the pressing member (41) to move outwards to reset, one end of the pressing member (41) extends out of the pump housing (11), the pressing member (41) is configured to press against the trigger elastic piece (31) to close the normally-open switch (3) when the pressing member (41) moves towards inside the pump housing (11).

4. The dual-purpose air pump according to claim 3, wherein the pump housing (11) is further provided with a mounting groove (105), the mounting groove (105) is provided with a manual switch member (5) configured to be moved up and down along the mounting groove (105), a first part of the manual switch member (5) is exposed outside the pump housing (11), and a second part of the manual switch member (5) extends into an interior of the pump housing (11), the trigger elastic piece (31) is provided with a switch ramp inclined relative to the mounting groove (105), the manual switch member (5) presses against the switch ramp to close the normally-open switch (3) when moving up or down.

5. The dual-purpose air pump according to claim 4, wherein an upper end of the manual switch member (5) or a lower end of the manual switch member (5) is provided with a bolt rod (51), and the pressing member (41) is provided with a vertical bolt hole (411) corresponding to the bolt rod (51), when the manual switch member (5) is moved to a position where the switch ramp is pressed, the bolt rod (51) is inserted into the vertical bolt hole (411) to limit a movement of the manual switch member (5) relative to the pump housing (11).

6. The dual-purpose air pump according to claim 1, wherein the bottom of the housing (2) is provided with a valve core for sealing the air inlet and outlet (21), and a bottom of the pump housing (11) is provided with a pushing bevel (106) configured to push the valve core open when the power switch is rotated towards the switch trigger, the valve core is connected with an elastic resetting member (61) configured to drive it the valve core to reset thereof to seal the air inlet and outlet (21).

7. The dual-purpose air pump according to claim 6, wherein the valve core comprises a cover plate (62) which covers a lower end face of the air inlet and outlet (21), a sealing ring (63) disposed on an upper surface of the cover plate (62), and a bearing member (64) fixed on the upper surface of the cover plate (62), an upper end of the bearing member (64) extends into an interior of the housing (2), and the upper end of the bearing member (64) is provide with a bearing bevel (641) which cooperates with the pushing bevel (106).

8. The dual-purpose air pump according to claim 7, wherein a lower surface of the housing (2) is provided with a support frame (65), the cover plate (62) is located between the housing (2) and the support frame (65), an inner side of the support frame (65) is provided with a vertical guide post (651), and the cover plate (62) is provided with a guide hole (621) matching the guide post (651).

9. The dual-purpose air pump according to claim 1, wherein the bottom of the housing (2) is provided with a pressing spring (8) configured to press the pump body (1) upward so that the limiting table (102) abuts against the locking device.

10. A dual-purpose air pump, comprising a pump body (1) and a housing (2) configured to be fixed to an inflatable product, wherein the housing (2) is provided with an accommodating cavity (20) with a top opening, and a bottom of the housing (2) is provided with an air inlet and outlet (21), the pump body (1) configured to be inserted into the accommodating cavity (20) and rotationally mated with the housing (2), an upper end of the pump body (1) is provided with a twirling part (101) configured to rotate relative to the housing (2) together with the pump body (1), and the twirling part (101) protrudes from an upper end face of the housing (2);

the pump body (1) comprises a pump housing (11), an outer side wall of the pump housing (11) is provided with a limiting table (102), the housing (2) is provided with a locking device configured to move to an upper part of the limiting table (102) to limit upward movements of the pump body (1), when the locking device is moved away from the upper part of the limiting table (102), the locking device allows the pump body (1) to move upwards and detach from the accommodating cavity (20);

the pump body (1) is provided with a power switch, and the housing (2) is internally provided with a switch trigger configured to close the power switch, when the pump body (1) rotates, the power switch is configured to be rotated to a position triggered by the switch trigger;

wherein the power switch comprises an elastic button, the switch trigger comprises a ramp (22) provided along an inner side wall of the housing (2) in a circumferential direction, the elastic button is squeezed by the ramp (22) to close the power switch when the elastic button is rotated to a position where the ramp (22) is located.

11. A dual-purpose air pump, comprising a pump body (1) and a housing (2) configured to be fixed to an inflatable product, wherein the housing (2) is provided with an accommodating cavity (20) with a top opening, and a bottom of the housing (2) is provided with an air inlet and outlet (21), the pump body (1) configured to be inserted into the accommodating cavity (20) and rotationally mated with the housing (2), an upper end of the pump body (1) is provided with a twirling part (101) configured to rotate relative to the housing (2) together with the pump body (1), and the twirling part (101) protrudes from an upper end face of the housing (2);

the pump body (1) comprises a pump housing (11), an outer side wall of the pump housing (11) is provided with a limiting table (102), the housing (2) is provided with a locking device configured to move to an upper part of the limiting table (102) to limit upward movements of the pump body (1), when the locking device is moved away from the upper part of the limiting table (102), the locking device allows the pump body (1) to move upwards and detach from the accommodating cavity (20);

the pump body (1) is provided with a power switch, and the housing (2) is internally provided with a switch trigger configured to close the power switch, when the pump body (1) rotates, the power switch is configured to be rotated to a position triggered by the switch trigger;

wherein the bottom of the housing (2) is provided with a pressing spring (8) configured to press the pump body (1) upward so that the limiting table (102) abuts against the locking device.

* * * * *